US007057333B1

(12) United States Patent
Vu Thien et al.

(10) Patent No.: US 7,057,333 B1
(45) Date of Patent: Jun. 6, 2006

(54) METHOD AND DEVICE FOR EXTRACTION OF ELECTRONS IN A VACUUM AND EMISSION CATHODES FOR SAID DEVICE

(75) Inventors: Binh Vu Thien, Lyons (FR); Jean-Pierre Dupin, Villeurbanne (FR); Paul Thevenard, Caluire (FR)

(73) Assignee: Universite Claude Bernard Lyon I, Villeurbanne (FR)

( * ) Notice: Subject to any disclaimer, the term of this patent is extended or adjusted under 35 U.S.C. 154(b) by 0 days.

(21) Appl. No.: 09/926,489

(22) PCT Filed: May 12, 2000

(86) PCT No.: PCT/FR00/01297

§ 371 (c)(1),
(2), (4) Date: Dec. 14, 2001

(87) PCT Pub. No.: WO00/70638

PCT Pub. Date: Nov. 23, 2000

(30) Foreign Application Priority Data

May 12, 1999 (FR) ..... 99 06254

(51) Int. Cl.
*H01J 1/30* (2006.01)

(52) U.S. Cl. ..... 313/311; 313/495; 313/496; 313/326; 313/310; 257/10; 445/24

(58) Field of Classification Search ..... 313/309–311, 313/495, 499; 445/50, 51; 257/10
See application file for complete search history.

(56) References Cited

U.S. PATENT DOCUMENTS 3,098,168 A 7/1963 Aigrain ..... 313/346
3,114,070 A 12/1963 Stratton ..... 313/346

(Continued)

FOREIGN PATENT DOCUMENTS

EP 0696043 2/1996

(Continued)

OTHER PUBLICATIONS

'Serial Process for Electron Emission from Solid-state Field controlled Emitters ' by Vu Thien Binh, J.P. Duprin, P. Thevenard, S.T. Purcell, and V. Semet. J. Vac. Sci. Technol. B 18(2), Mar./Apr. 2000.*

(Continued)

*Primary Examiner*—Karabi Guharay
*Assistant Examiner*—Sikha Roy
(74) *Attorney, Agent, or Firm*—Dennison, Schultz, Dougherty & MacDonald

(57) ABSTRACT

The method of the invention for extracting electrons in a vacuum consists in:

making a cathode presenting at least one junction (9) between a metal (7) acting as an electron reservoir and an n-type semiconductor (8) possessing a surface potential barrier with a height of a few tenths of an electron volt, and presenting thickness lying in the range 1 nm to 20 nm;

injecting electrons through the metal/semiconductor junction (9) to create a space charge in the semiconductor (8) sufficient to lower the surface potential barrier of the semiconductor to a value that is less than or equal to 1 eV relative to the Fermi level of the metal (7); and using the bias source creating an electric field in the vacuum to control the height of the surface potential barrier ($V_p$) of the n-type semiconductor in order to control the emission of the electron flux towards the anode.

17 Claims, 9 Drawing Sheets

U.S. PATENT DOCUMENTS

| | | | | |
|---|---|---|---|---|
| 3,121,809 | A | 2/1964 | Atalla | 307/88.5 |
| 3,916,227 | A | 10/1975 | Mize | 313/500 |
| 3,964,084 | A * | 6/1976 | Andrews et al. | 257/475 |
| 5,243,197 | A * | 9/1993 | Van Gorkom et al. | 257/10 |
| 5,266,867 | A | 11/1993 | Sakurai | 313/632 |
| 5,283,501 | A * | 2/1994 | Zhu et al. | 315/169.3 |
| 5,359,257 | A | 10/1994 | Bunch et al. | 313/310 |
| 5,773,920 | A * | 6/1998 | Shaw et al. | 313/309 |
| 6,177,701 | B1 * | 1/2001 | Matsumoto | 257/310 |
| 6,417,606 | B1 * | 7/2002 | Nakamoto et al. | 313/336 |
| 6,635,979 | B1 * | 10/2003 | Shiratori et al. | 313/309 |

FOREIGN PATENT DOCUMENTS

| | | |
|---|---|---|
| FR | 964760 | 8/1950 |
| FR | 1225675 | 7/1960 |
| JP | 05342983 | 12/1993 |
| JP | 08007746 | 1/1996 |
| WO | 9806135 | 2/1998 |

OTHER PUBLICATIONS

XP-002126517 "Ballistic Electron Emission Microscopy Study of Schottky Contacts on 6H- and 4H-SiC", Im et al, Applied Physics Letters, vol. 72, No. 7, 1998, pp. 839-841.

XP-004081165 "Electron emission Characteristics of Metal/Diamond Field Emitters", Sugino et al, Elsevier Science S.A., vol. 6, No. 5-7, pp. 889-892.

XP-000749210 "Theory and Experimental Results of a New Diamond Surface-Emission Cathode", Geis et al, The Lincoln Laboratory Journal, vol. 10. No. 1, pp. 3-18.

* cited by examiner

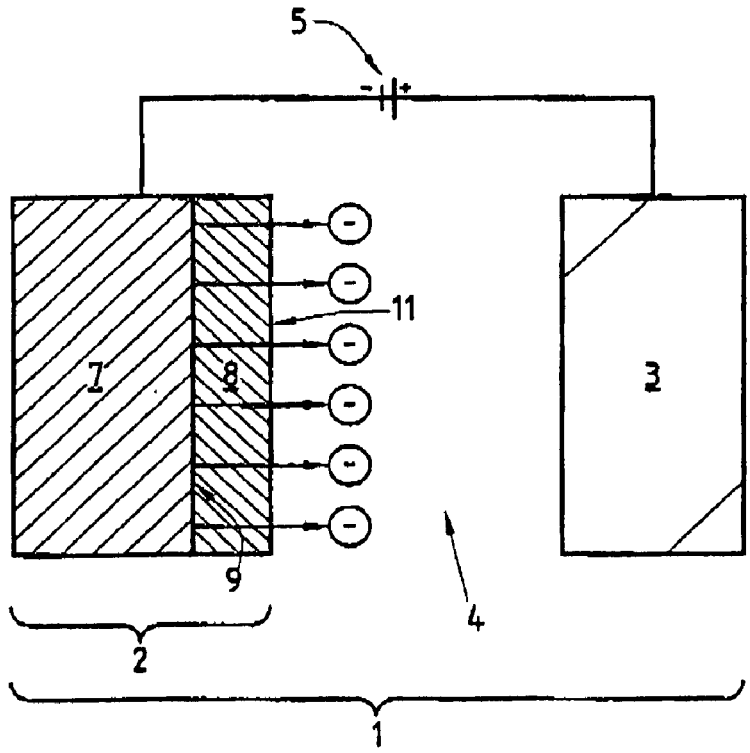
FIG.1
FIG.2Bis
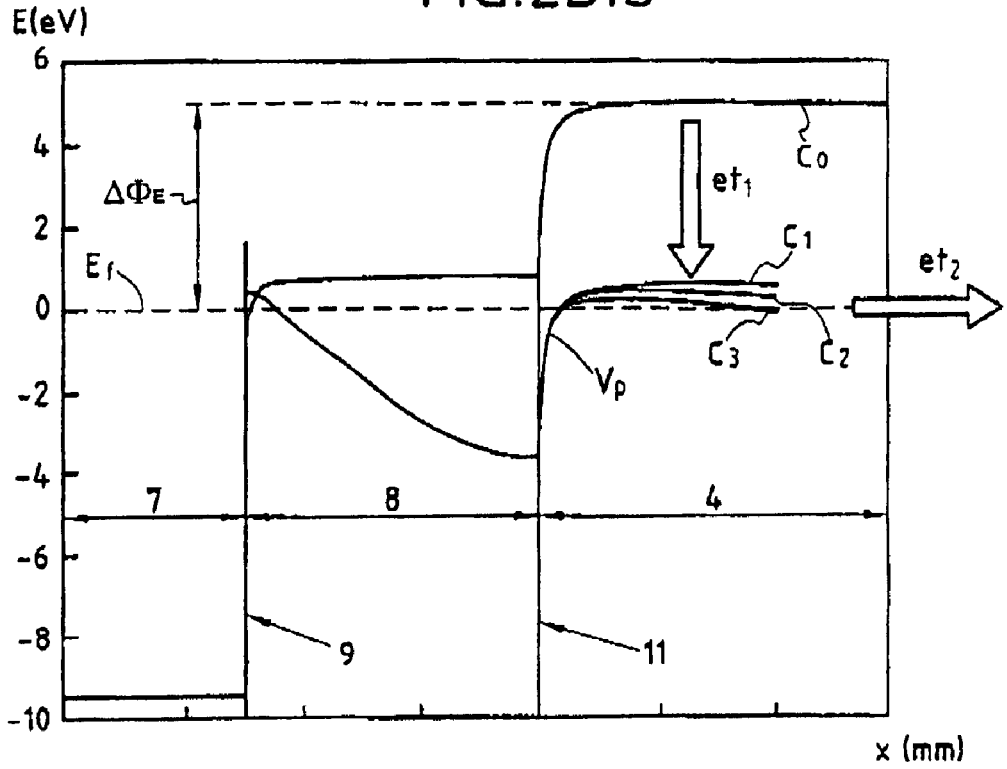

METHOD AND DEVICE FOR EXTRACTION OF ELECTRONS IN A VACUUM AND EMISSION CATHODES FOR SAID DEVICE

TECHNICAL FIELD

The present invention relates to the field of emitting electrons in a vacuum from a cathode in the broad sense.

The subject matter of the invention thus covers the field of electron sources in the broad sense suitable for use in electronic devices or for making flat screens, in particular.

PRIOR ART

In conventional manner, an electron extractor device comprises an emission cathode and an anode spaced apart from each other with a vacuum or an ultrahigh vacuum existing between them. The anode and the cathode are interconnected by means of a bias source serving to place them at a given relative potential.

In order to ensure that a constant flow of electrons is emitted into the vacuum from the cathode, it is necessary to extract the electrons from the potential in which they are trapped in the cathode material. Electrons can be extracted from the cathode by the technique of heating the cathode, so as to raise the energy of the electrons to a value which exceeds the work of emission which depends on the surface state of the cathode. That technique is known as thermionic emission and suffers from the drawback of requiring the cathode to be at high temperature (2700 kelvins (K) for a tungsten cathode, for example) and consequently of consuming relatively large amounts of energy and dissipating it as heat. Furthermore, that thermionic technique of emitting electrons does not enable localized electron emission sites to be obtained.

A second technique for extracting electrons is known in which the surface potential barrier of the cathode is deformed by means of an intense electric field. The height of the potential barrier depends only on the surface state of the cathode. That technique is known as field emission and it enables electrons to be emitted at a so-called "cold" temperature (300 K or less). A drawback of that technique lies in the need to implement a high vacuum ($10^{-10}$ Torr) in order to stabilize the electron emission current. Furthermore, in order to obtain an intense electric field, the cathode must necessarily be shaped so present a sharp point, and practical implementation of an array of points raises problems that are quite difficult. Furthermore, that technique does not enable electrons to be emitted in uniform manner from a plane surface.

Document WO 98/06135 discloses a device for extracting electrons which comprises a cathode situated at a distance from an anode. The cathode is constituted by a semiconductive film defining an emission surface for electrons and supported by an injection electrode. The emission surface has a front electrode enabling the injection electrode to be biased, so as to define the potential at the surface of the semiconductive film. Controlling this bias voltage enables electrons to be extracted from the cathode and enables the emission of electron flux towards the anode to be controlled.

It should be observed that electron emission is due to a thermionic phenomenon insofar as the electrons are excited by the energy contribution coming from electrons injected by the injection electrodes. Furthermore, the shape of the cathode requires technical means to be implemented that are difficult to achieve in practice.

An analysis of previously known techniques leads to the observation that there is a need for a technique that enables electrons to be extracted at low temperature and low electric field in a soft vacuum (as from $10^{-4}$ Torr), from an emission surface that is localized or uniform and that does not present particular problems of practical implementation.

SUMMARY OF THE INVENTION

The invention seeks to satisfy this need by proposing a method enabling the various objects specified above to be satisfied.

Accordingly, the invention provides a method of extracting electrons in a vacuum that are emitted from a cathode situated at a distance from an anode which is placed at a given potential relative to the cathode, by means of a bias source. According to the invention, the method consists in:

making a cathode presenting at least one junction between a metal serving as a reservoir of electrons and an n-type semiconductor, the cathode presenting an electron emission surface possessing a surface potential barrier with a height of a few tenths of an electron volt (eV), and presenting thickness lying in the range 1 nanometer (nm) to 20 nm, defined by the value of the lowering desired for the surface potential barrier;

injecting electrons through the metal/semiconductor junction to create a space charge in the semiconductor sufficient to lower the surface potential barrier of the semiconductor to a value that is less than or equal to 1 eV relative to the Fermi level of the metal; and using the bias source that creates an electric field in the vacuum to control the height of the surface potential barrier of the n-type semiconductor, so as to modify in reversible manner the electron affinity of the n-type semiconductor surface in order to control the emission of an electron flux towards the anode.

The invention also provides a device for extracting electrons in a vacuum as emitted from a cathode situated at a distance from at least one anode placed at a given potential relative to the cathode by means of a bias source. According to the invention, the device comprises:

an emission cathode having at least one junction between a metal and an n-type semiconductor, possessing a surface potential barrier with a height of a few tenths of an electron volt, the n-type semiconductor presenting an emission surface for electrons and possessing thickness lying in the range 1 nm to 20 nm defined by the value of the lowering desired for the surface potential barrier; and a bias source creating an electric field in the vacuum serving firstly to inject electrons through the metal/semiconductor junction so as to create a space charge in the semiconductor sufficient to lower the surface potential barrier of the semiconductor to a value that is less than or equal to 1 eV relative to the Fermi level of the metal, and also to control the height of the surface potential barrier of the n-type semiconductor, i.e. to reversibly modify the electron affinity of the surface of the n-type semiconductor in order to control electron flux emission.

The invention also provides a novel electron-emission cathode for a cathode extraction device, the cathode comprising:

a first portion forming an electron reservoir and constituted by at least one metal layer; and a second portion forming a conduction medium for the electrons injected into the metal layer and formed by an n-type semiconductor co-operating with the metal layer to define a metal/semiconductor junction possessing a potential barrier with a height of a few tenths of an electron volt, the n-type semiconductor presenting an emission surface for the electrons, and possessing thickness lying in the range 1 nm to 20 nm defined by the value of the lowering desired for the surface potential barrier.

Various other characteristics appear from the following description made with reference to the accompanying drawings which show embodiments and implementations of the invention as non-limiting examples.

BRIEF DESCRIPTION OF THE DRAWINGS

FIG. 1 is a block diagram showing a device for extracting electrons in a vacuum in accordance with the invention.

FIG. 2*bis* is a diagram showing the energy bands E (cV) for the cathode as a function of the position x taken in the cathode-anode direction.

BEST METHOD OF PERFORMING THE INVENTION

Figure 2:
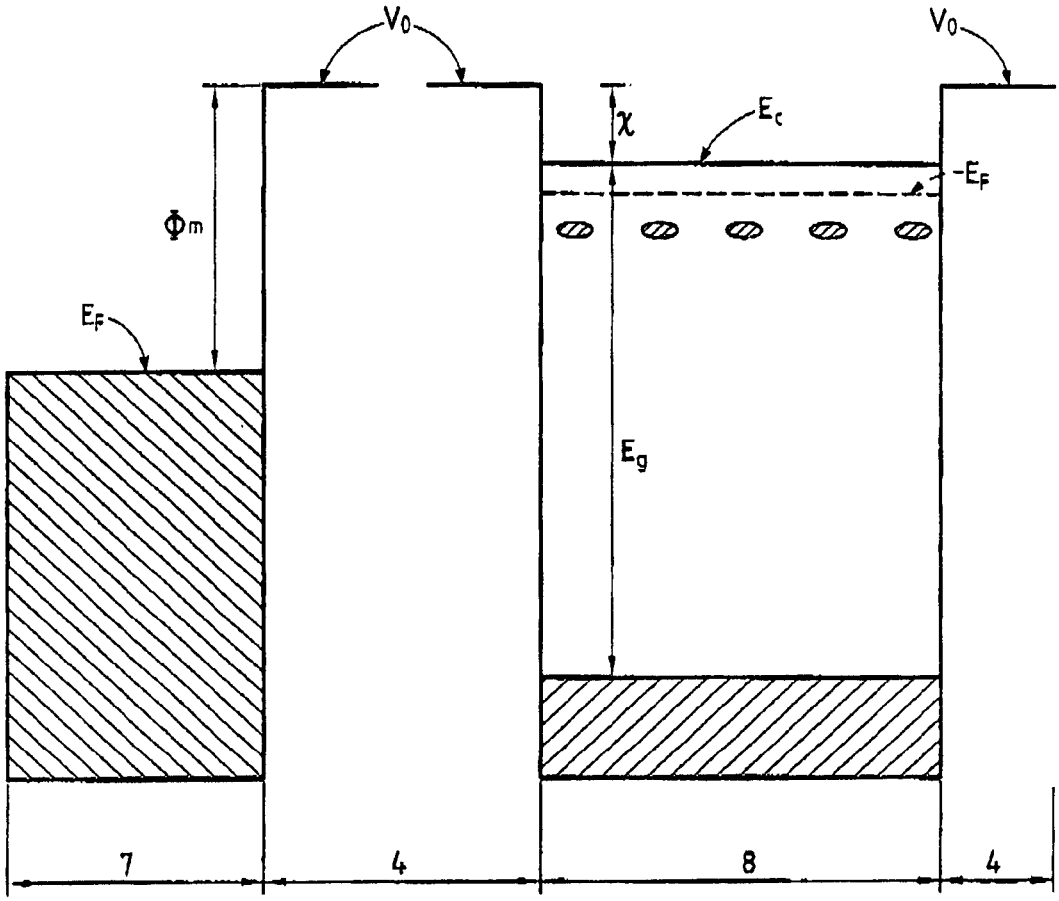
FIG. 2 is an energy-band diagram when the metal is initially separate from the semiconductor, for explaining the principle of the invention.

As can be seen in FIG. 1, the subject matter of the invention relates to a device 1 enabling electrons to be extracted in a vacuum, the device comprising an emission cathode 2 spaced apart from at least one anode 3 which in the example shown constitutes an anode for receiving electrons emitted by the cathode 2. The cathode 2 and the anode 3 define between them a volume 4 in which there is a vacuum ($10^{-4}$ Torr to $10^{-8}$ Torr) or an ultrahigh vacuum ($10^{-8}$ Torr to $10^{-12}$ Torr). The extraction device 1 also comprises a bias source 5 enabling the cathode 2 to be placed at a given potential relative to the anode 3. Practical implementation of the extraction device 1 is not described in greater detail below insofar as it is well known in the state of the art.

In accordance with the invention, the extraction device 1 comprises an emission cathode 2 having a first portion 7 forming an electron reservoir and constituted by at least one metal layer. The emission cathode 2 also has a second portion 8 forming a conduction medium for injected electrons. The conduction medium 8 is formed by an n-type semiconductor co-operating with the metal layer 7 to define a metal/semiconductor (Schottky) electron junction 9. According to an advantageous characteristic of the invention, the Schottky junction 9 has a potential barrier to a height of a few tenths of an electron volt, i.e. lying in the range 0.05 eV to 1 eV, and preferably about 0.1 eV. The characteristics of this Schottky junction require an appropriate pair of metal 7 and n-type semiconductor 8 to be selected. For example, when the metal 7 is platinum, the semiconductor layer 8 can be either n-type silicon carbide (SiC) or n-type rutile ($TiO_2$) obtained by sputtering.

According to another advantageous characteristic of the invention, the n-type semiconductor presents an emission surface 11 for electrons extracted in a vacuum 4. The semiconductor 8 presents defined thickness between the Schottky junction 9 and the emission surface 11, said thickness lying in the range 1 nm to 20 nm. The value of this thickness is defined by the amount of lowering desired for the surface potential barrier. By way of example, the thickness of the semiconductor 8 can be about 5 nm for semiconductor layers of n-type silicon carbide (SiC) or of n-type rutile or titanium dioxide ($Tio_2$) on a metal layer of platinum. In a preferred embodiment, the semiconductor 8 is a large-gap n-type semiconductor, i.e. it has a gap greater than or equal to 3 eV.

FIG. 2 shows the energy bands of the metal layer 7 and of the semiconductor 8 relative to the vacuum 4 when they are separate from one another. The metal layer 7 has a Fermi level $E_f$ and work of emission $\Phi_m$ between the Fermi level and the potential level $V_0$ of the vacuum 4. The semiconductor 8 presents a forbidden band of width $E_g$, a conduction band of level $E_c$, a Fermi level $E_f$, and electron affinity $\chi$ relative to the potential level $V_0$ of the vacuum 4. While the Schottky junction is being made between the metal layer 7 and the n-type semiconductor 8, energy adjustment occurs leading to the same Fermi level and potential of the vacuum 4. Thus, as can be seen in FIG. 2*bis*, the cathode 2 as made in this way presents a metal layer 7 with a Fermi level $E_f$ and co-operating with the n-type semiconductor 8 to define a Schottky junction 9. At the surface 11 of the semiconductor 8, there exists a surface potential barrier $V_p$.

The extraction device 1 of the invention uses the bias source 5 to enable electrons to be emitted by means of a two-stage serial process. The first stage represents injecting electrons into the semiconductor 8 to form a space charge Q that is sufficient to lower the surface potential barrier $V_p$ of the semiconductor 8 to a value which is less than or equal to 1 eV relative to the Fermi level of the metal 7. This first stage is followed by a second stage which consists in reversibly regulating the emission of electrons towards the anode 3 by means of the bias source 5 creating an electric field F in the vacuum 4 that enables the height of the surface potential barrier $V_p$ of the semiconductor 8 to be controlled.

FIG. 2*bis* illustrates the process whereby electrons are emitted by two consecutive stages. In the first stage $et_1$, the surface potential barrier $V_p$ of the semiconductor 8 is lowered to a value which is less than or equal to 1 eV relative to the Fermi level $E_f$ of the metal 7. The energy difference between the maximum value of the surface potential barrier on the semiconductor 8 and the Fermi level of the metal 7 is represented by $\Delta\Phi E$. This lowering of the surface potential barrier of the semiconductor 8 (passing from curve $C_0$ to curve $C_1$) is due to electrons being injected under the influence of the bias source 5 through the junction 9 and to space charge Q being created in the semiconductor 8. The lowering of the surface potential barrier of the semiconductor 8 is an increasing function of the space charge Q which is itself an inverse function of the thickness of the semiconductor 8.

During the second stage $et_2$, electrons are emitted towards the anode 3 under the control of the bias source 5 which establishes a variable electric field F in the vacuum 4 thus enabling the surface potential barrier $V_p$ to be modulated. The surface potential barrier $V_p$ (curves $C_1$, $C_2$, $C_3$) is lowered for increasingly high values of the electric field F. The stage $et_2$ can thus be observed to comprise three characteristic behaviors for the cathode relative to the value of the electric field F created in the vacuum by the bias source 5, as shown more particularly in FIGS. 3 to 5.

Figure 3:
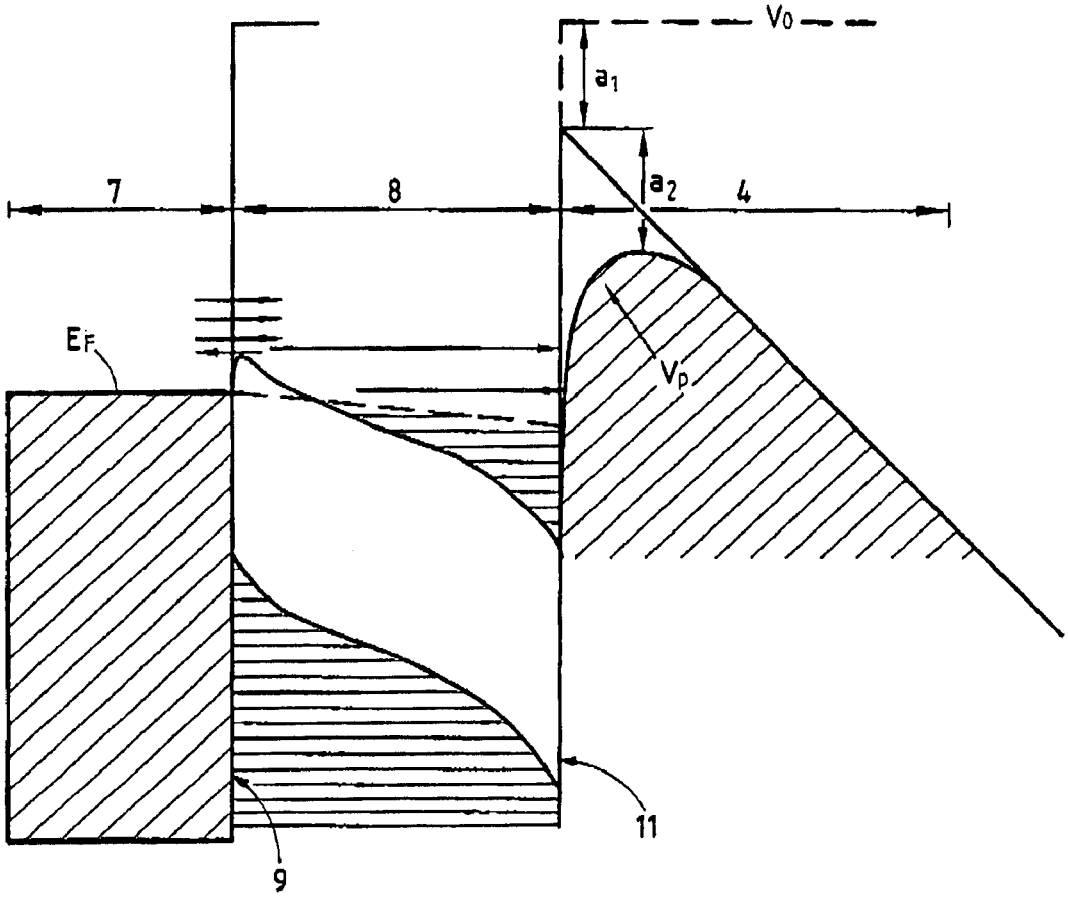
FIGS. 3, 4, and 5 are energy-band diagrams at the cathode as obtained during three characteristic stages of the method of the invention.
Figure 6:
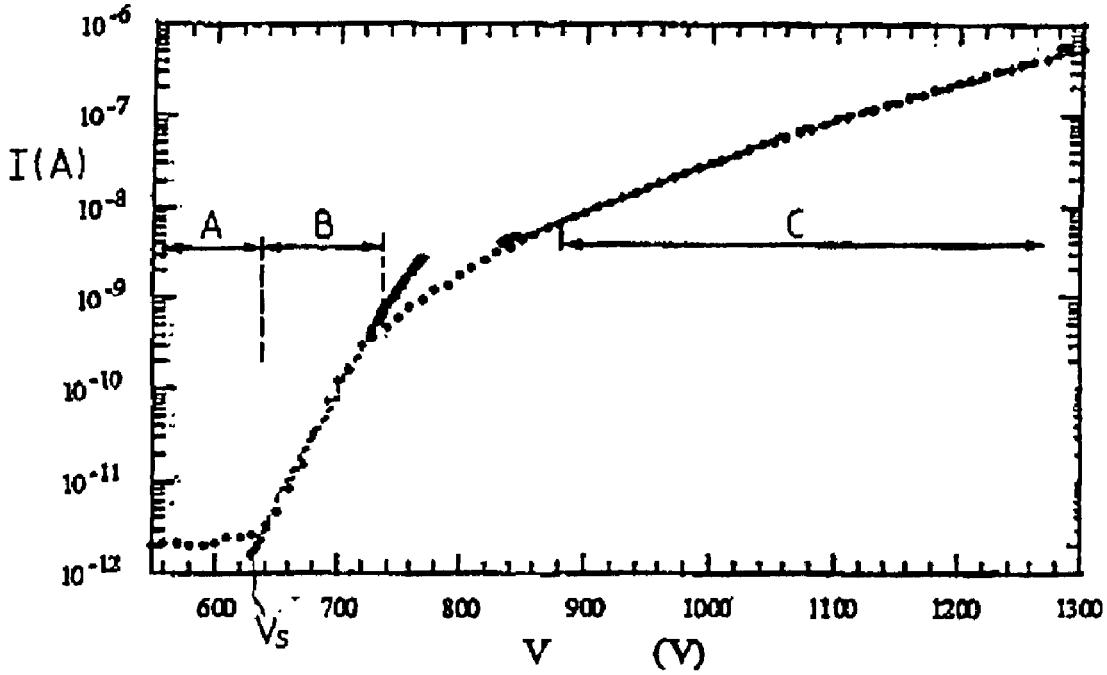
FIG. 6 is a graph showing how the current obtained varies as a function of the applied bias voltage.

FIG. 3 shows a first behavior of the cathode 2 in which the voltage applied by the bias source 5 is lower than a threshold value $V_s$ from which an electron current can be measured. At this voltage value, an electric field F is applied which leads to a first lowering $a_1$ of the height of the surface potential barrier that results from the band being curved due to penetration of the electric field F and to a space charge Q being created by electrons being injected from the metal 7 into the semiconductor 8. A lowering $a_2$ is also obtained of the height of the surface potential barrier of the semiconductor because of the Schottky effect. It should be observed that the presence of the electric field F also leads to the surface potential barrier of the semiconductor 8 being deformed. In the example shown in FIG. 3, the total lowering of the potential ($a_1$+$a_2$) of the surface potential barrier $V_p$ of the semiconductor, as obtained by a given electric field corresponding to a voltage that is low and less than the threshold value $V_s$ is not sufficient to allow electrons to be emitted. The surface potential barrier $V_p$ is thus too high to enable electrons to be emitted into the vacuum 4. The electrons injected through the electron junction 9 are trapped inside the semiconductor 8. It must be assumed that the height of the surface potential barrier of the n-type semiconductor is greater than the level of the states occupied by the electrons in the semiconductor 8. Portion A of FIG. 6 shows the curve of current I as a function of the potential V of the source 5, giving the current characteristic as obtained during this first stage of operation.

Figure 4:
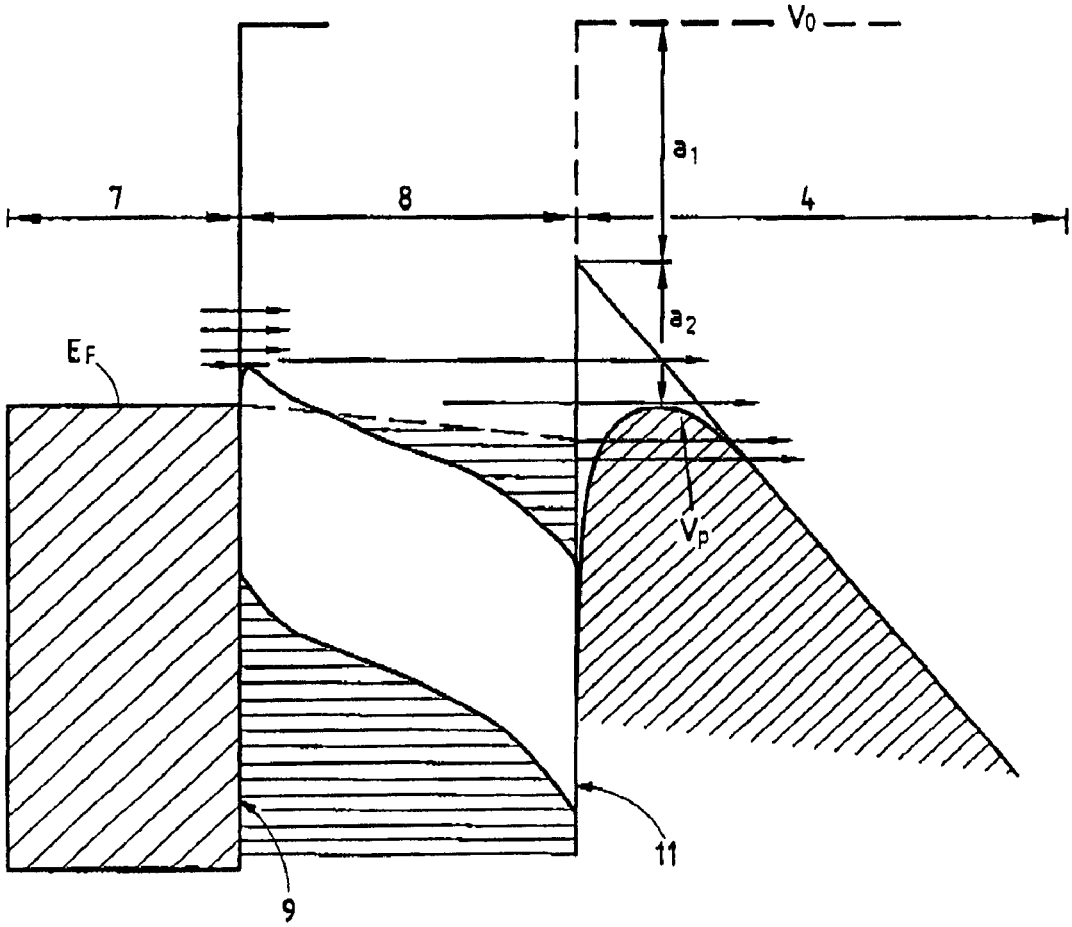

FIG. 4 shows a second characteristic behavior of the cathode 2 for an applied bias voltage that is greater than the threshold voltage $V_s$. The electric field F created in this way is such that the height of the surface potential barrier $V_p$ of the semiconductor 8 is substantially equal to the level of the states occupied by electrons in the semiconductor. The lowering ($a_1$+$a_2$) of the height of the surface potential barrier $V_p$ of the semiconductor is then sufficient to enable electrons to escape by the tunnel effect. This produces an emission surface 11 having low electron affinity resulting from the presence of the space charge Q and the penetration of the electric field. The field emission current I shown in portion B of the curve of FIG. 6 is governed by the Fowler Nordheim relationship characteristic of electron emission by the tunnel effect.

Figure 5:
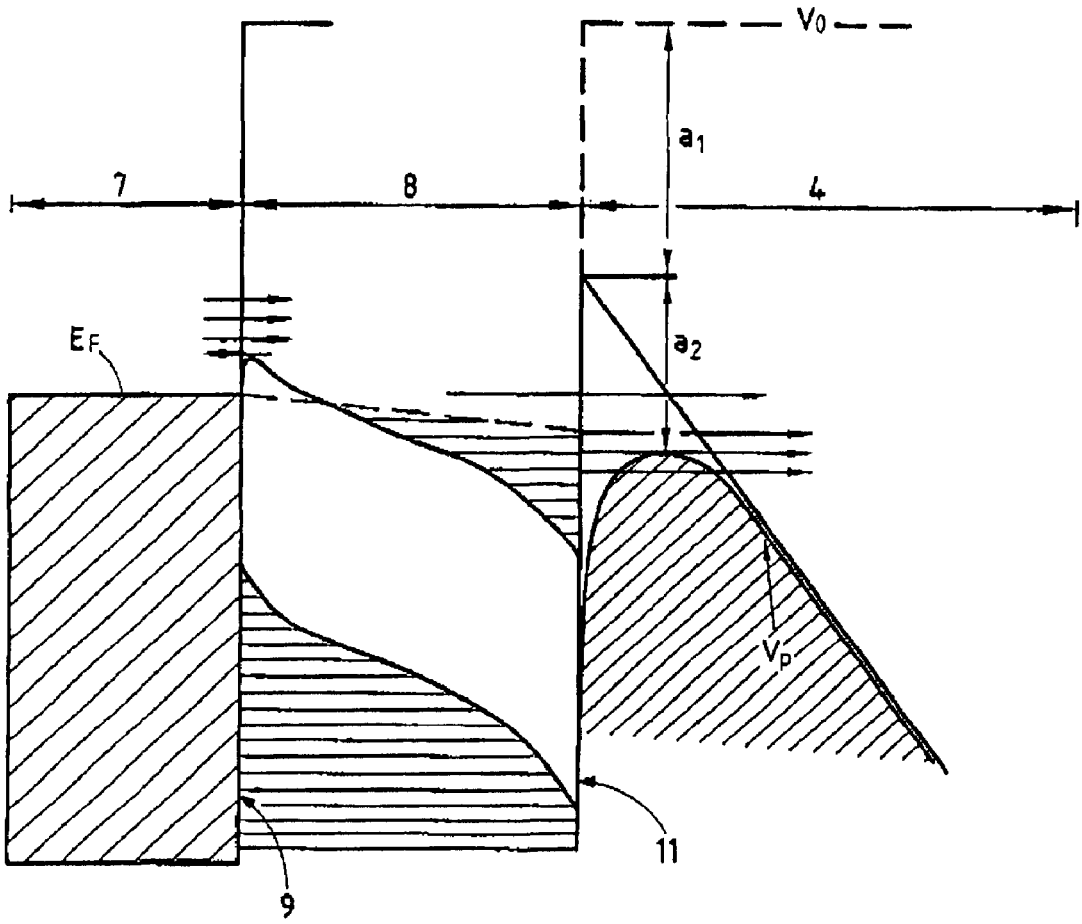
Figure 7:
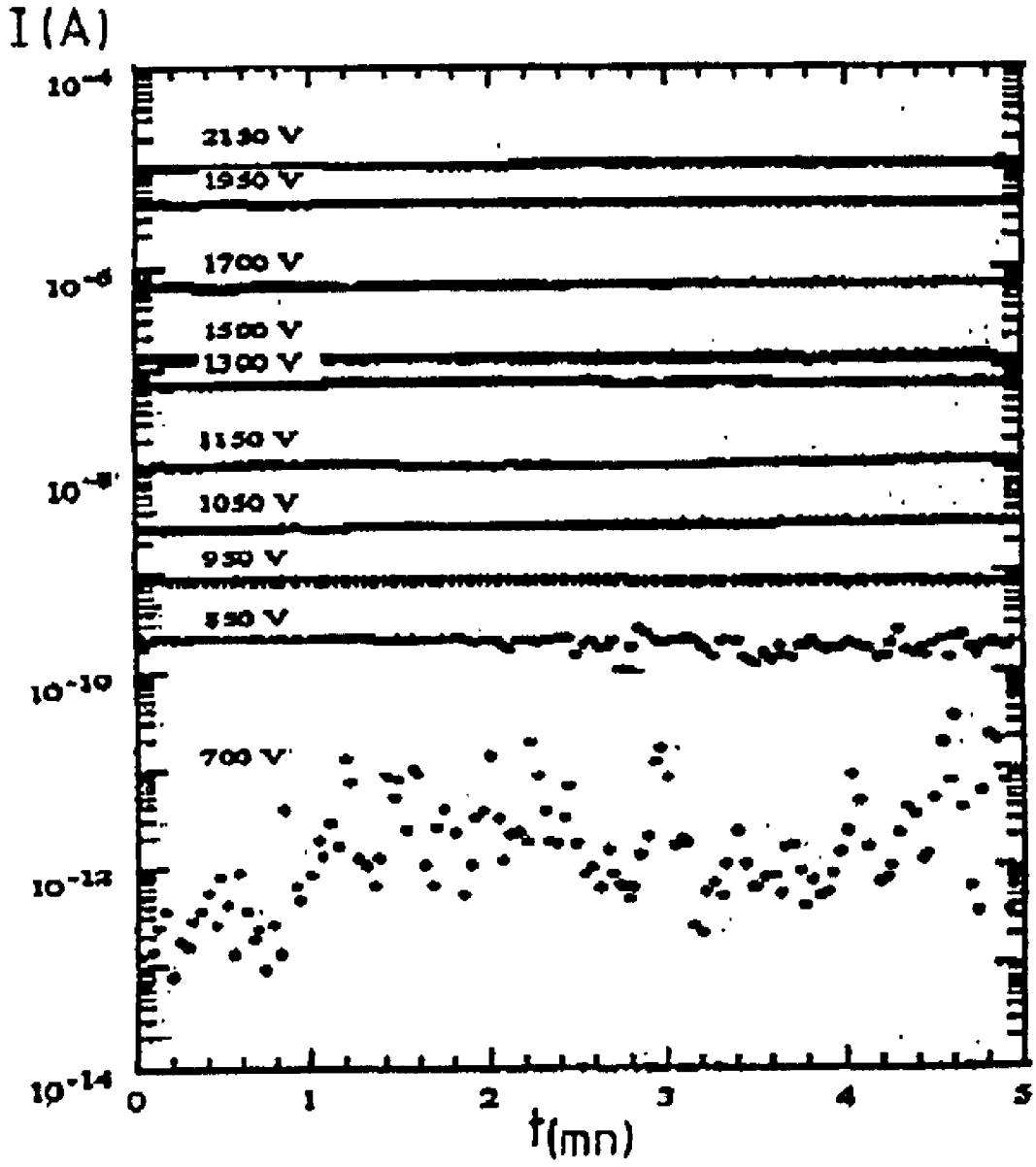
FIG. 7 is a diagram showing how the resulting emission current varies as a function of time for different bias voltage values.

FIG. 5 shows a third characteristic behavior of the cathode when the bias voltage V is much greater than the threshold voltage $V_s$. The bias voltage V is such that the electric field F created is adapted so that the height of the surface potential barrier $V_p$ of the semiconductor 8 is lower than the level of the states occupied by the electrons in the semiconductor 8. Surface emission 11 is thus obtained with negative electron affinity. The mechanism whereby the electrons are emitted is a kind of thermionic emission considering that electron injection is obtained from the metal/semiconductor junction 9. Portion C of the curve in FIG. 6 shows the form of the current I as a function of the applied voltage V for this third behavior. It must be understood that current emission operating under thermionic conditions is insensitive to small variations in the vacuum barrier due to adsorption. As can be seen more clearly in FIG. 7, current stability increases with increasing bias voltage V because electron injection is unaffected by the modifications that can appear in the vacuum 4.

The method of the invention thus makes it possible to control the emission of a flux of electrons by controlling the height of the surface potential barrier $V_p$ of the semiconductor 8 which is directly associated with the value of the bias voltage V. In this second stage, surface emission can be obtained that does not emit electrons (FIG. 3), that presents low electron affinity (FIG. 4), or negative electron affinity (FIG. 5).

A technical advantage of the invention is to present an injection interface which is a solid junction between a metal and a semiconductor. Electron injection is thus protected from influences of the environment, such as the phenomena of adsorption, desorption, ion bombardment, etc. In addition, the emission surface of the cathode after the first stage $et_1$ is a surface having low or negative electron affinity. Electron emission is practically insensitive to influences from the environment, such as the phenomena of adsorption, desorption, ion bombardment, etc. Furthermore, it should be observed that the emission current is very sensitive to temperature, so provision can be made to control the temperature of the cathode in order to control the flux of the emitted electron beam.

From the above, it can be seen that the emission surface depends directly on the electric field distribution on the emission surface 11 of the cathode. Thus, the presence of protuberances or projections on the emission face 11 can serve to confine electron emission to such projections. Naturally, it can also be envisaged to cause electrons to be emitted from a surface that is plane.

Figure 8:
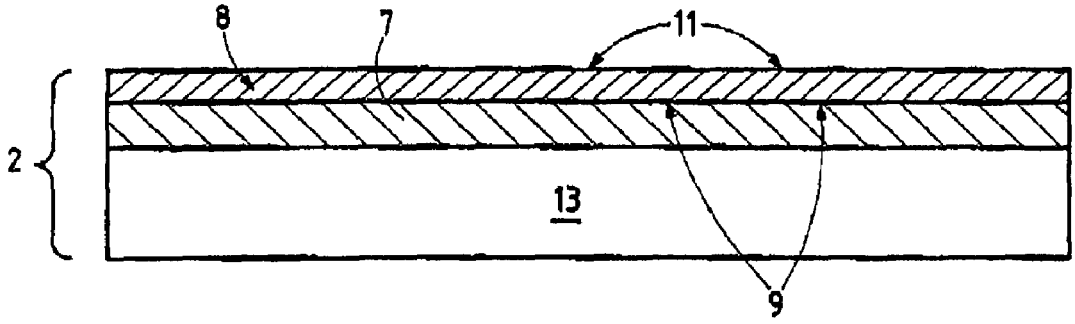
FIGS. 8, 9, and 10 show various embodiments of a plane cathode enabling the method of the invention to be implemented.
Figure 9:
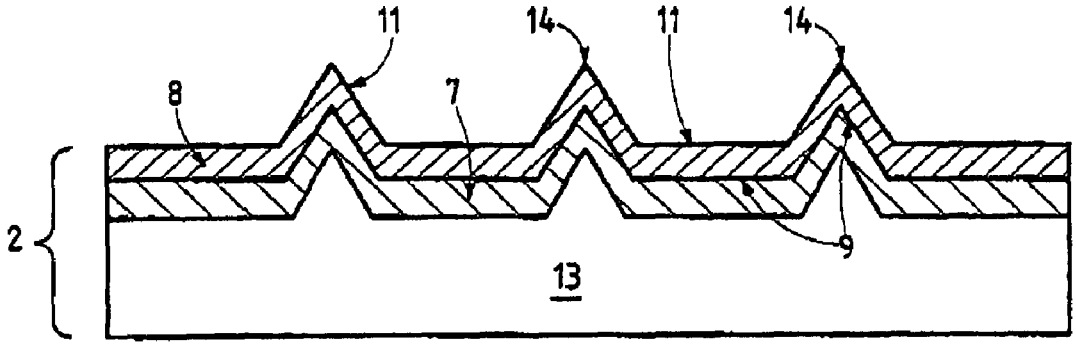
Figure 10:
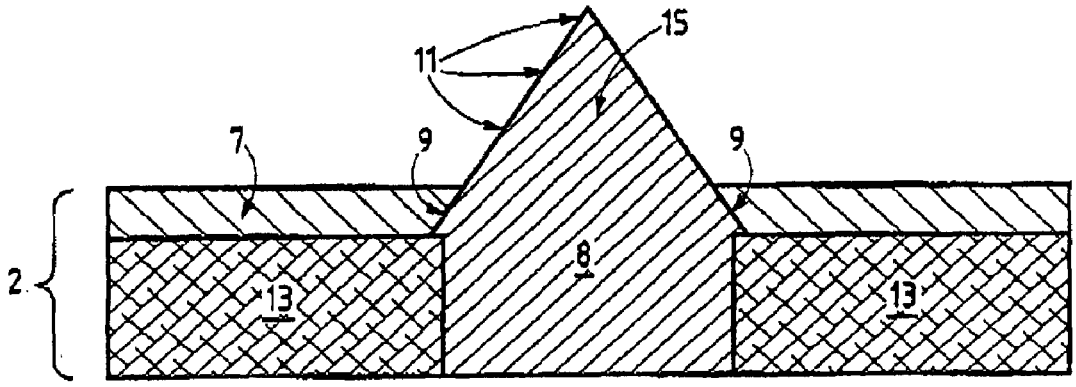

FIGS. 8 to 10 show various embodiments of a cathode 2 for implementing the extraction method of the invention. According to an advantage of the invention, the cathode 2 can be made using planar fabrication technologies that are conventional in microelectronics.

FIG. 8 shows a cathode 2 comprising a first portion forming an electron reservoir and constituted by a metal layer 7 carried by a substrate 13 that is metallic, semiconductive, or insulating. The metal layer 7 is coated in an n-type semiconductor layer 8 enabling the Schottky junction 9 to be implemented. The semiconductor layer 8 is made using conventional microelectronic doping technologies, such as ion implanting or deposition, e.g. of the chemical vapor deposition (CVD) type, sputtering, evaporation, in a vacuum, or physical vapor deposition (PVD). In this embodiment, the emission surface 11 is substantially plane. In another embodiment that can be seen in FIG. 9, an emission surface 11 is made that presents protuberances or projections 14 at determined locations. For this purpose, a substrate 13 is made out of a semiconductor or a metal whose place for receiving the metal layer 7 is etched by lithographic techniques so as to make projections that are to receive superposed thereon the metal layer 7 and the n-type semiconductor layer 8. As can be seen clearly in FIG. 9, the semiconductor element 8 thus presents an emission surface 11 with localized zones 14 for space confinement of emission electrons at the tips of the projections 14.

FIG. 10 shows another variant embodiment of a cathode of the invention comprising a metal layer 7 deposited on an insulating substrate 13. The assembly made in this way is subjected to ion bombardment so as to enable point-shaped projections 15 to appear that also form n-type semiconductor elements 8. A metal/semiconductor junction 9 thus appears where the projection passes through the metal layer 7.

Figure 11:
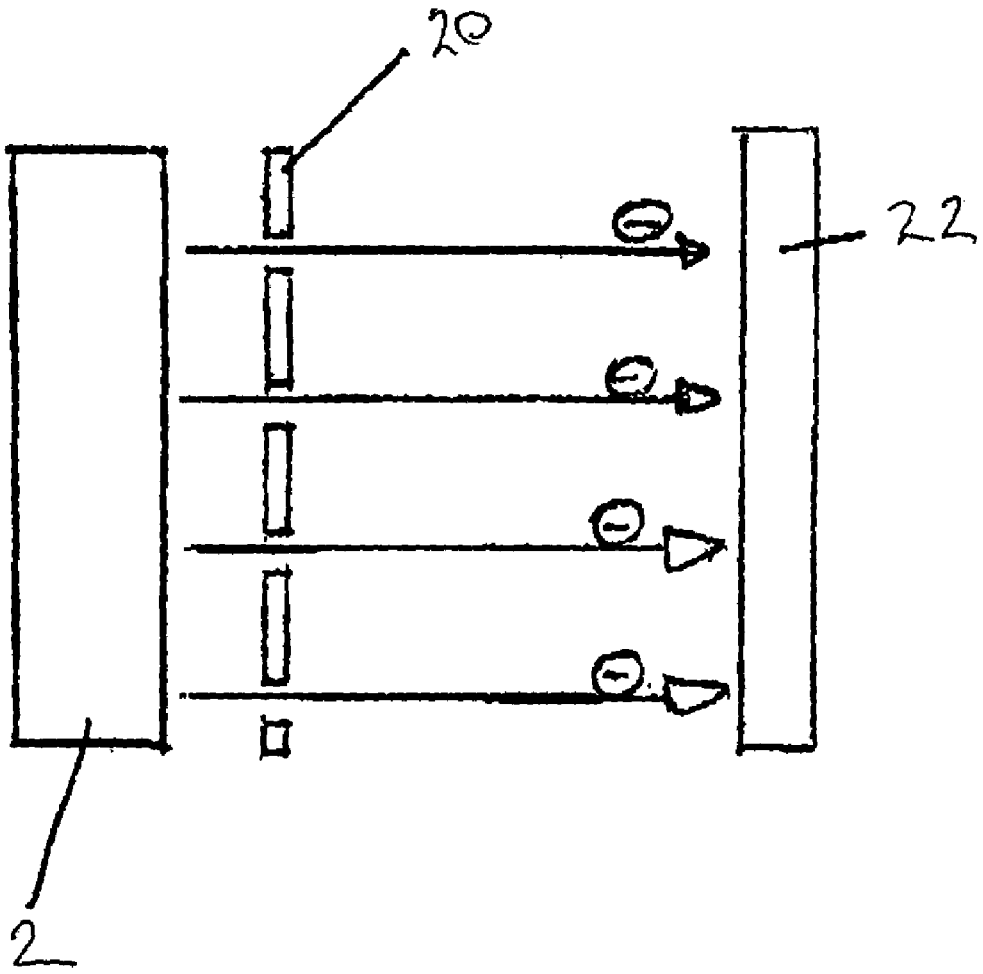
FIG. 11 shows in schematic cross section application of a device of the invention to the manufacture of flat screens.

There are numerous applications for the electron extraction device of the invention in the field of electronics, in particular for constituting a source for vacuum electronic components or for making flat screens. In the application of the invention for making flat screens, as shown in FIG. 11, provision can be made in conventional manner to implement a first electron extraction electrode (cathode) 2, which is placed close to extraction anode 20 and allowing electron beams to pass of an intensity that is modulated locally for each pixel of the screen. These beams are picked up by a reception anode 22 placed downstream from the extraction anode relative to the emission cathode. It should be observed that by making the substrate 13 carrying the metal layer 7 out of a semiconductor material, it is possible to integrate active electronic components in the substrate for the purpose of locally controlling the emission of electrons.

Another particularly advantageous application of the subject matter of the invention lies in producing parallel and uniform electron beams for projection electron lithography.

In the embodiments described with reference to FIGS. 8 to 10, the substrate 13 is plane in shape. This shape is particularly suitable for devices that require a planar electron source (e.g. flat screens that can reach dimensions of square meter ($m^2$) order or more, electronic components of smaller dimensions, of square millimeter ($mm^2$) order, or of the order of several tens of square centimeters ($cm^2$)). Naturally, the substrate 13 can have other types of shape as a function of the application. For example, the substrate 13 can be in the form of an individual point or an individual pinhead for making cathodes in individual electron guns. Such guns are used in particular in electron microscopes and in cathode ray tubes (CRTs).

The invention is not limited to the examples described and shown since numerous modifications can be applied thereto without going beyond the ambit of the invention.

The invention claimed is:

1. A method of extracting in a vacuum electrons emitted from a cathode situated in spaced-apart relationship with an anode which is placed at a given potential relative to the cathode by means of a bias source, the method comprising:

making a cathode presenting at least one junction between a metal serving as a reservoir of electrons and an n-type semiconductor, the junction possessing a surface potential barrier with a height in a range of 0.05 to 0.5 eV, the n-type semiconductor presenting an emission surface for electrons and having a thickness lying in a range of 1 nm to 20 nm, defined by the value of the lowering desired for the surface potential barrier;

injecting electrons through the metal/semiconductor junction to create a space charge in the semiconductor sufficient to lower the surface potential barrier of the semiconductor to a value that is less than or equal to 1 eV relative to the Fermi level of the metal; and using the bias source that creates an electric field in the vacuum to control the height of the surface potential barrier of the n-type semiconductor, so as to modify in reversible manner the electron affinity of the n-type semiconductor surface in order to control the emission of an electron flux towards the anode.

2. A method according to claim 1, wherein the bias source is controlled so as to create an electric field suitable for causing the height of the surface potential barrier of the n-type semiconductor to be greater than the level of the states occupied by electrons in the n-type semiconductor so as to obtain an emission surface that does not emit electrons.

3. A method according to claim 1, wherein the bias source is controlled so as to create an electric field suitable for causing the height of the surface potential barrier of the n-type semiconductor to be substantially equal to the level of the states occupied by electrons in the n-type semiconductor, in order to obtain an emission surface having low electron affinity.

4. A method according to claim 1, wherein the bias source is controlled so as to create an electric field suitable for causing the height of the surface potential barrier of the n-type semiconductor to be lower than the level of the states occupied by electrons in the n-type semiconductor so as to obtain an emission surface of negative electron affinity.

5. A method according to claim 1, wherein the temperature of the cathode is controlled in order to control the flux of the emitted electron beam.

6. A method according to claim 1, wherein the metal-semiconductor junction possesses a potential barrier of height lying in the range of approximately 0.1 eV.

7. A device for extracting in a vacuum electrons emitted from a cathode situated in a spaced-apart relationship with at least one anode placed at a given potential relative to the cathode by means of a bias source, the device:

an emission cathode having at least one junction between a metal and an n-type semiconductor, possessing a surface potential barrier with a height in a range of 0.05 to 0.5 eV, the n-type semiconductor presenting an emission surface for electrons and possessing thickness lying in the range 1 nm to 20 nm defined by the value of the lowering desired for the surface potential barrier; and a bias source creating an electric field in the vacuum serving firstly to inject electrons through the metal/semiconductor junction so as to create a space charge in the semiconductor sufficient to lower the surface potential barrier of the semiconductor to a value that is less than or equal to 1 eV relative to the Fermi level of the metal, and also to control the height of the surface potential barrier of the n-type semiconductor, i.e. to reversibly modify the electron affinity of the surface of the n-type semiconductor in order to control electron flux emission.

8. A device according to claim 7, including an electron extraction electrode followed by an anode for receiving the extracted electrons.

9. An electron emission cathode for a device for extracting an electron beam in a vacuum in accordance with claim 7, the cathode comprising:

a first portion forming an electron reservoir and constituted by at least one metal layer; and a second portion forming a conduction medium for the electrons injected into the metal layer and formed by an n-type semiconductor co-operating with the metal layer to define a metal/semiconductor junction possessing a potential barrier with a height in a range of 0.05 to 0.5 eV, the n-type semiconductor presenting an emission surface for the electrons, and possessing thickness lying in the range 1 nm to 20 nm defined by the value of the lowering desired for the surface potential barrier.

10. An emission cathode according to claim 9, the metal/semiconductor junction possesses a potential barrier of height lying in the range of approximately 0.1 eV.

11. A cathode according to claim 9, wherein the first portion forming an electron reservoir is formed by a metal layer carried on a substrate of metal, semiconductor, or insulation.

12. A cathode according to claim 11, wherein the substrate possesses an individual point shape or an individual pinhead shape for use in an individual electron gun.

13. A cathode according to claim 9, wherein the n-type semiconductor possesses an emission surface for electrons that is substantially planar.

14. A cathode according to claim 13, wherein the n-type semiconductor possesses an emission surface for electrons presenting projections made in determined locations by lithographic techniques.

15. A cathode according to claim 13, wherein the n-type semiconductor possesses an emission surface for electrons presenting projections in the form of points, obtained by ion bombardment of the metal layer deposited on an insulating substrate.

16. A cathode according to claim 9, wherein the n-type semiconductor possesses an emission surface for electrons that presents projections enabling electron emission to be confined in register with each of them.

17. A device according to claim 7, wherein the metal-semiconductor junction possesses a potential barrier of height lying in the range of approximately 0.1 eV.

* * * * *